United States Patent [19]

Botkins et al.

[11] 4,263,722

[45] Apr. 28, 1981

[54] RECYCLE CONTROL FOR GRAIN DRYERS

[75] Inventors: Walter Y. Botkins; Jack D. Bussell, both of Overland Park; Nicholas B. Scott, New Strawn; William I. Wood, Waverly, all of Kans.

[73] Assignee: Berico Industries, Inc., Overland Park, Kans.

[21] Appl. No.: 93,220

[22] Filed: Nov. 13, 1979

[51] Int. Cl.[3] ..... F26B 21/12

[52] U.S. Cl. ..... 34/47; 34/54; 34/65; 34/169; 34/174

[58] Field of Search ..... 34/169, 174, 65, 46, 34/47, 48, 54

[56] References Cited

U.S. PATENT DOCUMENTS

| | | | |
|---|---|---|---|
| 1,001,259 | 8/1911 | Ellis . | |
| 1,669,012 | 5/1928 | Nordstrom . | |
| 1,926,772 | 9/1933 | Hess . | |
| 2,512,128 | 6/1950 | Albright . | |
| 2,701,920 | 2/1955 | Campbell | 34/65 |
| 2,764,819 | 10/1956 | Hallman | 34/169 |
| 3,313,040 | 4/1967 | Mathews . | |
| 3,373,503 | 3/1968 | Kline et al. . | |
| 3,440,734 | 4/1969 | Batterton et al. . | |
| 3,629,954 | 12/1971 | Lavalier | 34/174 |
| 3,701,203 | 10/1972 | Anderson . | |
| 3,786,573 | 1/1974 | Scheppe et al. . | |
| 3,879,859 | 4/1975 | Neville . | |
| 4,048,727 | 9/1977 | Botkins | 34/169 |
| 4,067,120 | 1/1978 | Bradford . | |
| 4,149,844 | 4/1979 | Noyes | 34/174 |

*Primary Examiner*—Larry I. Schwartz

*Attorney, Agent, or Firm*—Fishburn, Gold and Litman

[57] ABSTRACT

A recycle control is provided for grain dryers of the type which have a drying column area with heating and cooling zones and a recirculating air blower. During a recirculating mode of the grain dryer, the recirculating blower draws in a mixture of cooling air and heating air from the cooling and heating zones respectively and forces the mixture after additional heating back into the heating zone. The recycle control includes an inlet duct and adjustable louver arrangement which during partial recirculating mode selctively flows outside air into the mixture of cooling air and heating air at an intake portion of the recirculating blower to regulate the extent of dryer recirculation, and control grain drying. During a non-recirculating mode the recirculating blower draws in only outside air.

13 Claims, 5 Drawing Figures

RECYCLE CONTROL FOR GRAIN DRYERS

BACKGROUND OF THE INVENTION

The present invention relates to the drying of moisture-laden agricultural commodities, and in particular, to a recycle control for recirculating grain dryers.

Recirculating grain dryers, such as the device disclosed in the Botkins U.S. Pat. No. 4,048,727, are well known in the field of agriculture, and include at least one porous grain column constructed of a material such as a wire cloth screen which retains the grain therein, and permits hot air to be circulated therethrough. An arrangement is provided which recirculates at least a portion of the hot air which is blown into the grain and is otherwise exhausted into the atmosphere. Such recirculating grain dryers include a recirculating blower, which, in the recirculating mode, draws in preheated air from a cooling section of the dryer after passing through the grain, and/or a lower portion of a heating or drying section of the dryer. The preheated air is further heated, by a burner and is then blown back into the drying section. Because the drying air is partially preheated during the recirculating mode, less energy is required to ring the drying air up to the required temperature, thereby realizing a substantial savings in heating energy.

Recirculating grain dryers must be carefully regulated to control the temperature and humidity of the drying air. Excessively high drying air temperatures increase the hazard of fire or explosion, particularly when the commodity being dried has a great deal of free chaff or dust. Excessively high humidity in the drying air reduces efficiency of drying and may completely stop the drying process in addition to potentially doing damage to the components of the dryer. Further, the controls must be readily adjustable to accommodate for different atmospheric conditions, and various degrees of moisture content in the harvested commodity.

It is desirable that the degree or extent of recirculation be variable in accordance with the type of commodity to be dried. All crops contain some percentage of chaff which during drying becomes suspended in the recirculated air and is deposited on the porous, wire cloth grain columns. When the chaff buildup on the grain columns becomes excessive, the pores therein are blocked, and the entire dryer must be shut down and cleaned. Some commodities, such as milo, contain such a high chaff content that it is not economically feasible to operate the dryer with any degree of recirculation due to the rapid buildup of debris on the grain columns. Other commodities have a very low chaff content, such that they can typically be dried with the economical, full-recirculation mode. Hence, it is preferable that recirculating grain dryers include a recycle control which can vary the degree of recirculation from full to no recirculation, and provide for any possible partial recirculation therebetween.

SUMMARY OF THE INVENTION

The principal objects of the present invention are: to provide a recycle control for recirculating grain dryers to carefully regulate the temperature and humidity of the drying air; to provide such a recycle control for varying the degree of recirculation from full to no recirculation, and including any combination therebetween; to provide such a recycle control having means for selectively flowing outside atmospheric air into a recirculating blower of the dryer to economically achieve accurate temperature and humidity control of the drying air; to provide such a recycle control for dryers having a drying column area with both cooling and drying zones therein; to provide such a recycle control which includes a blower inlet duct with an inlet aperture and an adjustable closure therefor to meter outside air into the recirculating blower; to provide such a recycle control wherein the inlet duct further includes an adjustable recirculating air closure connected with an open end of the duct to control the amount of recirculated air therethrough; to provide such a recycle control wherein the air closure includes an adjustable louver in the inlet duct open end; to provide such a recycle control wherein the duct further includes an adjustable second closure which communicates through a fixed louver with the atmosphere which when in an open position allows flow of atmospheric air into the recirculating blower; to provide such a recycle control wherein the second closure also includes a second adjustable louver communicating directly with the atmosphere; and to provide such a recycle control which is economical to manufacture, efficient in use, capable of a long operating life, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENTS

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
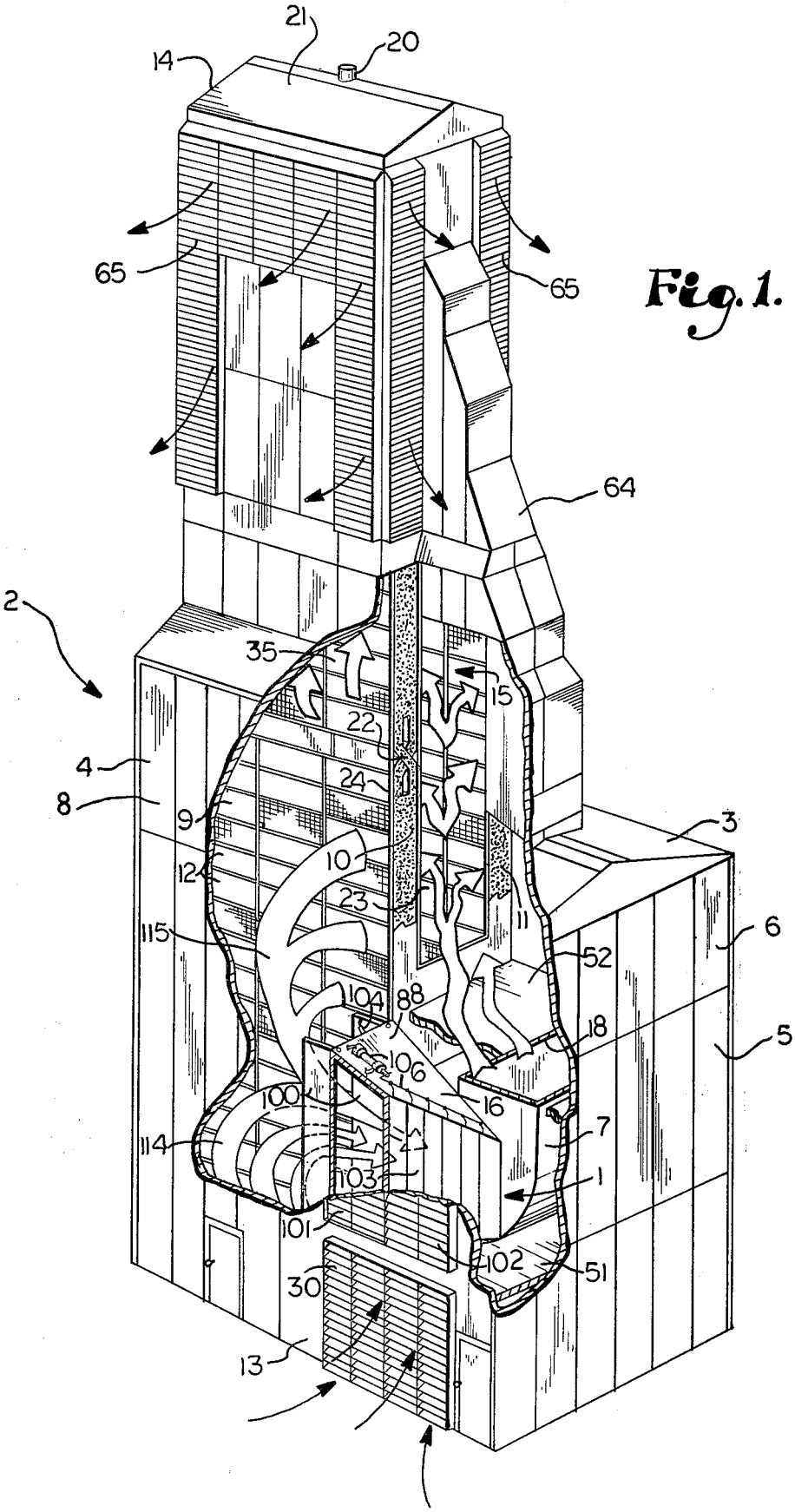
FIG. 1 is a perspective view of a recycle control associated with an inlet duct embodying the present invention, shown in a grain dryer, with portions thereof broken away.

For purposes of description herein, the terms "upper", "lower", "right", "left", "rear", "front", "vertical", "horozontal", and derivatives thereof shall relate to the invention as oriented in FIG. 1; however, it is to be understood that the invention may assume various alternative orientations, except where expressly specified to the contrary.

The reference numeral 1 generally designates a recycle control embodying the present invention. The recycle control 1 is adapted for use with an inlet duct of a recirculating grain dryer of the type which has a drying column area and a recirculating blower mounted in a room portion thereof. The illustrated grain dryer 2 has a building, enclosure, or housing 3 with interconnected side and end walls 4 and 5 respectively. The housing 3 includes a rearward end 6 in which a recirculating blower 7 is disposed, and a forward end 8, which is elevated from the rearward end 6, and includes the drying column area 9 therein. A pair of vertically oriented columns 10 and 11 are mounted in the forward end 8 of the housing in a parallel and spaced apart relation. The columns 10 and 11 are shaped to retain the grain to be dried therein, and are perforated or porous so as to allow air to be blown or forced therethrough.

Figure 2:
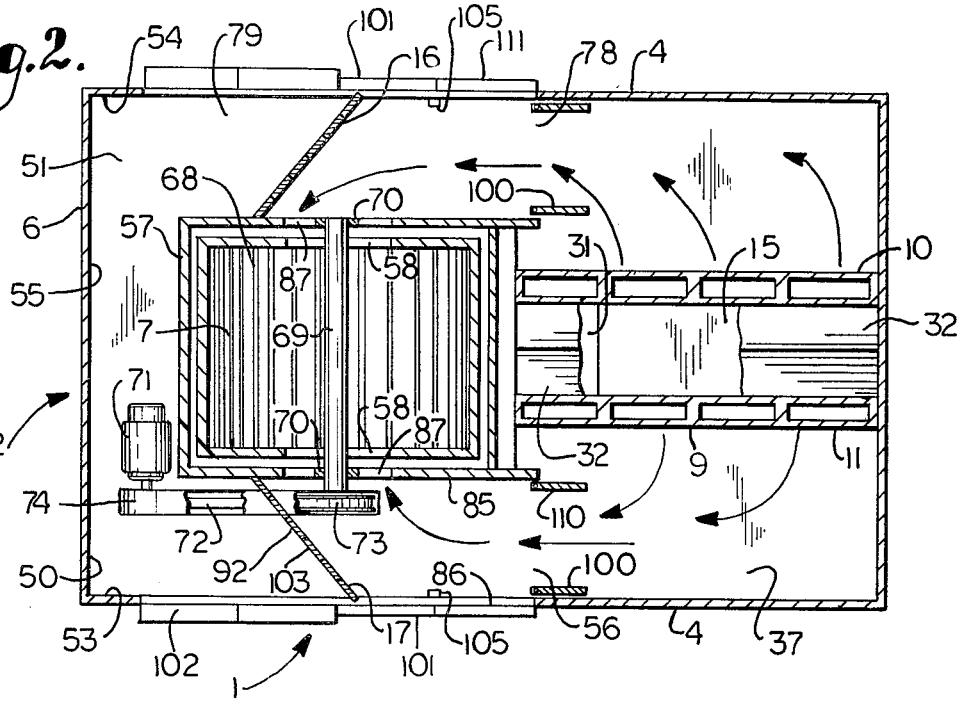
FIG. 2 is a horizontal cross-sectional view of the grain dryer, taken through a medial portion of the inlet duct illustrating a recirculating mode.

As best shown in FIG. 2, each of the illustrated columns 10 and 11 has four rectangularly shaped sections 12 which are mounted in a end-to-end relation, and are preferably constructed of a woven wire screen with a mesh size which provides maximum open area for air flow, yet securely retains the grain therein. The columns 10 and 11 extend from the base or bottom 13 of the housing to the top 14 thereof, and define an interior column space 15 thereinbetween, for purposes which will be explained hereinafter. The columns 10 and 11 are also positioned such that air in the interior space must normally pass through the columns 10 and 11 before exiting the dryer 2 or recirculating through the blower 7.

The recirculating blower 7 includes a pair of inlet ducts 16 and 17 disposed on opposite sides thereof and an outlet duct 18 opening at the top thereof. The outlet duct 18 opens into the interior column space 15.

The illustrated grain dryer 2 (FIG. 1) includes a filler spout 20 which extends through the uppermost roof portion 21 of the housing forward end 8, and is connected with the columns 10 and 11 to provide means for introducing or loading the grain into the dryer. Gravitational forces cause the grain to flow downwardly through the columns 10 and 11, and means such as a paddle wheel valve (not shown) are positioned at the lower end of each of the columns to regulate the flow of the grain through the dryer. Each of the illustrated columns 10 and 11 includes a flow diverting mechanism 22 adjacent to a medial portion thereof, which diverts the grain from the inside 23 to the outside 24 of the column, and vice versa, for uniform drying of the grain and increased drying efficiency.

Figure 4:
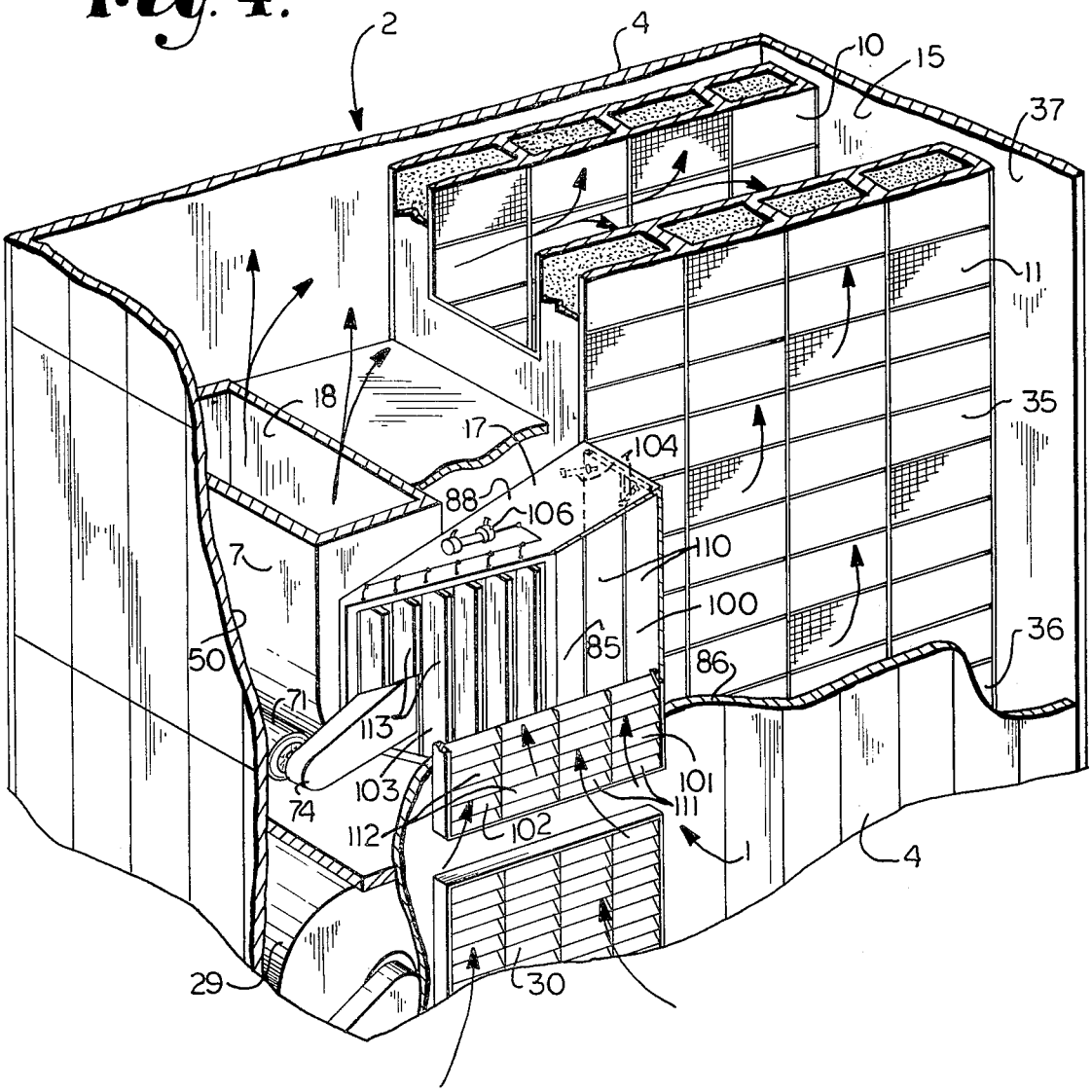
FIG. 4 is an enlarged partial perspective view of the dryer and inlet duct shown in a non-recirculating mode.
Figure 5:
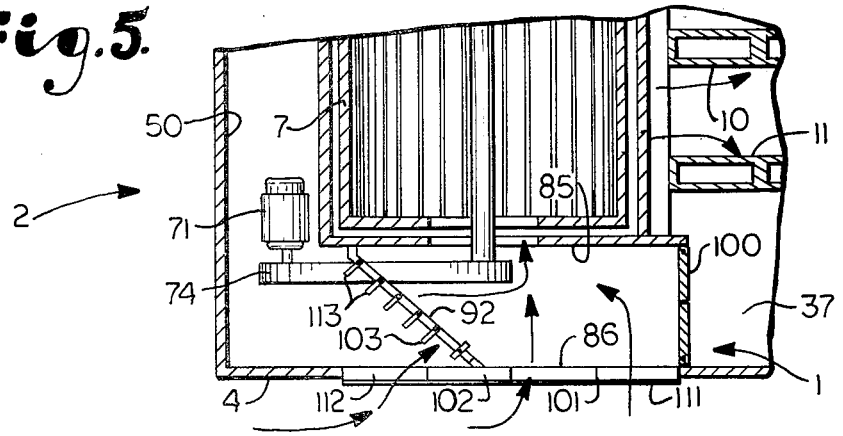
FIG. 5 is a partial horizontal cross-sectional view of the grain dryer as in FIG. 2, except illustrating the non-recirculating mode.

As best shown in FIGS. 4 and 5, the illustrated grain dryer 2 includes an intake blower 29, which is mounted on the housing base 13 rearward end 6, and draws outside air thereinto through a pair of lower louvers 30 disposed in the opposing housing side walls 4. In this example, the intake blower 29 is a centrifugal fan and, in particular, is a motor driven squirrel cage type blower. An intake blower outlet duct 31 (FIG. 2) directs the cool outside air which is drawn through the louvers 30 by the intake blower 29 into the interior column space 15 between the columns 10 and 11 at the lower portion thereof.

The grain dryer 2 preferably includes a damper in the nature of a butterfly valve 32 (FIG. 2) mounted between the two columns 10 and 11, and positioned vertically adjacent to the top of the outlet duct 31 to divide the interior column space 15 into upper and lower sections 35 and 36 respectively (FIG. 4). The upper section 35 is a heating portion, and the lower section 36 is a cooling portion. The valve 32 may be manipulated to control the intermixing of air between the heating and cooling sections 35 and 36, to accurately regulate the grain drying process. Further, the valve 32 directs the cool air which is blown into the cooling section 36 by the intake blower 29 outwardly through the lower portions of the columns 10 and 11 into outer exhaust cavities or ducts 37, which are formed between the outside surfaces of the columns 10 and 11 and the inside surfaces of the building sidewalls 4. The exhaust ducts 37 are disposed on opposing sides of the grain dryer, and extend from the bottom to the top of the columns.

The recirculating blower 7 is mounted in a room portion 50 of the grain dryer, which is disposed directly above the intake blower 29 in the rearward end 6 of the housing. The room portion 50 includes a floor 51, a ceiling 52, opposed sidewalls 53 and 54, a rear wall 55, and an open side 56 which communicates with and is oriented toward the drying column area 9. The recirculating blower 7 is a centrifugal fan type of blower having a generally arcuately shaped housing 57 with intake apertures 58 at a medial portion of each housing side, and the outlet duct 18 which extends through the ceiling 52 of the room portion 50 and is slightly enlarged from the blower exit 60. Heating means, such as the illustrated gas burner 61 are located in the recirculating blower outlet duct 59 to heat the air carried therethrough.

The recirculating blower outlet duct 18 is connected with a vertically oriented distribution duct 64 (FIG. 1), which directs the air blown from the recirculating blower 7 after being heated by the burner 61 into the heating section of the interior column space 15, above the butterfly valve 32. The heated air is thereby blown outwardly and forced through the columns 10 and 11, and the rain therein, and is exhausted into the exhaust ducts 37 provided on the exterior sides of the columns 10 and 11. Exhaust means such as outlet louvers 65 are provided in the upper portion of the housing walls to vent non-recirculated air in the exhaust ducts 37 to the atmosphere. The illustrated distribution duct 64 is inclined inwardly in a stepped fashion from the bottom to the top thereof to act as a baffle for evenly distributing the heated air between the columns 9 and 10.

The recirculating blower 7 (see FIG. 2) has a squirrel cage fan blade 68 mounted in the housing 57 on a shaft 69 with bearings or pillow blocks 70 located at each end thereof. The illustrated recirculating blower 7 is powered by a motor 71, which is preferably electric, and is mounted in the room portion 50 rearwardly of the blower housing 57. A drive belt 72 and pulley 73 are provided to transmit power from the motor 71 to the blower fan, and a safety guard 74 covers the belt 72.

The inlet duct 17 is connected with a side of the recirculating blower 7 associated with the motor 71 and the inlet duct 16 is connected to an opposite side of the recirculating blower 7. Each of the inlet ducts 16 and 17 extends from the drying column area 9 to the intake portion 58 of the recirculating blower. Each of the inlet ducts 16 and 17 have an open end 78 thereof disposed adjacent to the open side 56 of the room portion 50, whereby during a full recirculating mode of the grain dryer, air is drawn into the recirculating blower 7 not from the room 50, but substantially wholly from the drying column area 9, thereby alleviating the build-up of dust in stagnant areas of the room. Each of the ducts 16 and 17 has an aerodynamically streamlined interior shape with walls which taper convergingly inwardly from an open end 78 of each inlet duct 16 and 17 to the recirculating blower intake portion 58 for efficiently guiding the flow of air from the drying column area 9 into the recirculating blower intake 58 during recirculation. In the illustrated structure, each of the intake duct open ends 78 extends vertically from the floor 51 to the ceiling 52 of the room 50, and horizontally from an associated side wall 4 to the recirculating blower 7, thereby forming a substantially closed, dust free area 79 disposed rearwardly of the recirculating blower 7. The drive motor 71 for the recirculating blower 7 is mounted in the closed area 79, thereby isolating the same from exposure to debris in the recirculating air, so as to provide improved operational safety. The drive belt 72 extends through an aperture 80 in the rear of the inlet duct. A resilient seal may be provided at the intersection of each side of the belt 72 with the inlet duct 17.

Each of the illustrated inlet ducts 16 and 17 include inner and outer side wall panels 85 and 86 respectively which are oriented in a substantially parallel relationship in the longitudinal direction of the grain dryer. Each of the inner panels 85 is positioned adjacent to the side wall of the recirculating blower housing 57 and includes an aperture 87 therethrough which mates with the inlet aperture 58. Each of the outer panels 86 is positioned abutting the sidewall 4 of the housing 3. Each of the ducts 16 and 17 also include top and bottom panels 88 and 89 respectively which are interconnected with the inner and outer panels 85 and 86. The top panel 88 extends from the room ceiling 52 downwardly to near recirculating blower intake 58, and the bottom panel 89 extends from the room floor 51 upwardly to near the blower intake 58. The top and bottom panels 88 and 89 are flat and converge inwardly from the inlet duct open end 78 to the recirculating blower intake 58 to form a streamlined design for efficient air flow therethrough. A rear panel 92 is connected between respective outer panels 86 and inner panels 85 at an angle in a downstream direction thereto, whereby the duct interior shape tapers inwardly toward the blower intake portion 58. In the illustrated structure, the rear panel 92 has a trapezoidal shape and intersects the inner panel 85 at an angle in the nature of 50° at a point spaced just rearwardly of the rearwardmost portion of the inlet aperture 87. Respective outer side panels 86 and duct rear panels 92 intersect at a longitudinally medial portion of each inlet duct 16 and 17. An arcuately shaped deflector or flashing 93 is connected with the upper and lower edges of each inlet duct open end 78, to streamline the air flow into the associated inlet duct 16 or 17. The panels of the inlet ducts 16 and 17 are preferably constructed of a thin, rigid material, such as sheet metal, and are sufficiently strong to withstand high velocity air therethrough. As best illustrated in FIG. 2, each of the inlet ducts 16 and 17 has a width between the associated inner and outer panels 85 and 86 which is substantially commensurate with that of the exhaust ducts 37, and the same are vertically aligned, such that both the hot and cool exhaust air is efficiently drawn into the recirculating blower 7 through the inlet ducts 16 and 17.

Although the illustrated embodiment of the present invention includes outer panels 86 which are separate from the associated housing sidewalls 4, and inner panels 85 which are separate from the associated side portions of the blower housing 57, it is to be understood that the overlapping portions of the inner and outer panels 85 and 86 may be eliminated by incorporating the same into the associated portion of the housing sidewall and blower side respectively, without deviating from the intent of the present invention.

The recycle control 1 of the present invention includes means for selectively flowing ambient atmospheric air into a mixture of cooling air and heating air from the exhaust ducts 37 at the intake portion of the recirculating blower 7, thereby regulating the extent of grain dryer 2 recirculation. In particular, the recycle control 1 may be selectively adjusted so as to produce a complete or total recycle mode within the dryer 2 wherein 100% of the air passing through the recirculating blower 7 is drawn from the exhaust ducts 37. The recycle control 1 may also be selectively adjusted to produce a total non-recycle mode within the dryer 2 wherein none of the air drawn into the recirculating blower 7 comes from within the exhaust ducts 37, rather such air comes from outside or ambient atmospheric air. In addition, the recycle control 1 may be selectively adjusted into partial recycle modes to provide for a plurality of various ratios of recycle air being taken from the ducts 37 and ambient air being taken from the outside, such that the humidity and temperature of the recycle air may be positively controlled.

The recycle control 1 of the illustrated embodiment includes for each of the inlet ducts 16 and 17: adjustable closure means, such as louver 100, adapted for selectively closing off an associated intake aperture 58; second adjustable closure means, such as louver 101 associated with each of the outer panels 86 and louver 103 in the rear panel 92; and nonadjustable closure means, such as louver 102 adjacent to the louver 101. Each of the louvers 100 comprise a pair of vertically oriented doors 110 which open outwardly into the ducts 37 on suitable hinges or pivot pins. A hand controlled or mechanically driven actuator, such as actuator and hydraulic ram 104 or other suitable device well known in the art, is used to selectively adjust the positioning of each of the louvers 100. Each of the louvers 101 comprises a plurality of horizontally oriented fins 111 which, when opened, allow communication of air through the respective outer panels 86 between the inlet ducts 16 and 17 and the outside atmosphere. The fins 111 for each of the louvers 101 pivot about a horizontal axis on suitable hinges or pivot pins and are selectively adjusted by a hand or mechanical actuator, such as actuator and hydraulic ram 105 or other suitable device well known in the art. Each of the louvers 102 provide access of air through an associated wall 4 and comprise a plurality of nonadjustable horizontally oriented fins 112. The fins for each of the louvers 102 are maintained in an open position and allow air flow therethrough from the atmosphere. As illustrated, each of the louvers 101 and 102 include two adjacent columns of fins 111 and 112 respectively. Each of the louvers 103 comprise a plurality of vertically oriented fins 113 which pivot about a vertical axis upon suitable hinges or pivot pins. The fins 223 for each of the louvers 103 are controlled by a hand or mechanical actuator, such as actuator ahd hydraulic ram 106 or other suitable device well known in the art. The fins of each of the louvers 103 are selectively adjustable between open and closed positions and, when in an open position, allow communication of air between the associated inlet ducts 16 or 17 and the outside atmosphere through respective louvers 102.

Figure 3:
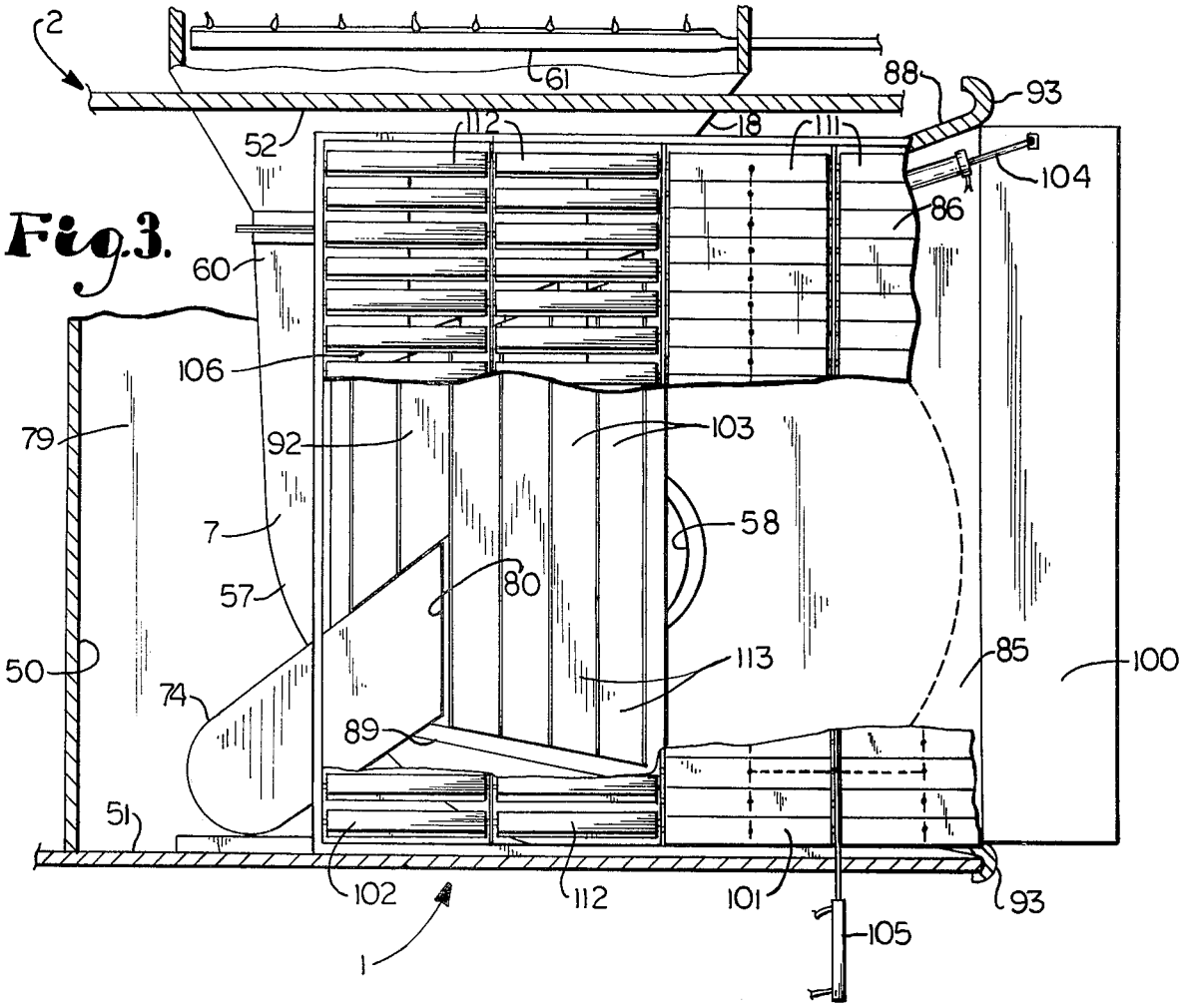
FIG. 3 is a fragmentary, vertical cross-sectional view of the grain dryer, showing a recirculating blower and fresh air intake therefor in the recirculating mode.

In use, the grain dryer 2 operates such that grain enters the filter spout 20 and gravitates downward through the dryer columns 10 and 11. The grain is selectively removed from the dryer 2 after drying is complete. During the grain drying process outside air is drawn through the lower louvers 30 into the intake blower 29, and is expelled therefrom under pressure through the outlet duct 31 into the cooling portion 36 of the interior column space 15. The air is then forced outwardly through the columns 10 and 11 into the associated exhaust ducts 37, thereby cooling the grain in the column cooling sections 36, and raising the temperature of the cooling air. The recirculating blower 7 when in a total or partial recycle mode, such as shown in FIGS. 1, 2 and 3, draws in air through the inlet ducts 16 and 17 from the exhaust ducts 37. The air which is drawn into the inlet ducts 16 and 17 includes some exhaust cooling air (schematically illustrated by the arrow noted by reference numeral 114), and some exhaust heating air (schematically illustrated by the arrow marked with the reference numeral 115). The recirculating blower 7 forces air drawn into same back into the interior column space 15 via various ductwork after adding additional heat to the air at the burner 61. It is to be noted that both sources of air have passed through at least a portion of one of the drying columns 10 and 11, and have therefore picked up chaff and other debris which is carried into the inlet ducts 16 and 17. Since the recirculated air is drawn not from the room portion 50, but substantially wholly from the drying column area 9 via the inlet ducts 16 and 17, the hazardous build-up or collection of dust and debris in relatively stagnant areas of the room is alleviated. The aerodynamically streamlined interior shape of the inlet duct walls efficiently guide the flow of air from the exhaust duct 37 directly into the recirculating blower 7. Because of the arrangement of the inlet ducts 16 and 17 in conjunction with the blower housing 57, the rearward portion of the room 50 is substantially closed and dust free. The drive motor 71 for the recirculating blower 7 is mounted in the isolcated area 79, so as to reduce the hazard of fire and/or explosion of the dust.

When the dryer recycle control 1 is in a total recycle mode, as is illustrated in FIGS. 1, 2 and 3, the louvers 101 and 103 are completely closed thereby blocking outside or atmospheric air from entering associated inlet ducts 16 and 17 and the louvers 100 are open allowing air to recycle from the ducts 37 through the recirculating air blower 7 back to the drying columns 9 and 10. In this recycle mode substantial savings can be realized in heating the recirculating air stream provided that the relative humidity in the recirculating stream remains sufficiently low to continue to dehydrate the grain when reheated and as long as there is sufficiently low amounts of dust and chaff to avoid fire or plugging of the screens on the interiors of the drying columns 10 and 11. Conditions would not always be appropriate for total recycle; however, a situation wherein corn having very little dust is being dried and atmospheric air having a very low relative humidity is being utilized, recycle air (94 and 95 combined) may approach 90 to 100% of total air passing through the recirculating blower 7.

When the dryer recycle control 1 is in a total non-recycle mode, as is illustrated in FIGS. 4 and 5, each of the louvers 101 and 103 are completely open thereby allowing atmospheric air to communicate with and enter the recirculating blower 7 and each of the louvers 100 are completely closed thereby blocking air from entering the inlet ducts 16 and 17 from the ducts 37. In such a non-recycle mode, essentially all of the air entering the dryer 2 through the intake blower 29 exits the dryer 2 through the discharge or top louvers 65 without passage through the recirculating blower 7. In the non-recycle mode the dryer 2 can be utilized to dry crops such as milo which have a high succeptability to fire or large amount of chaff and/or during weather conditions wherein relative humidity in the recycle air approaches 100% and thus produces moisture drops and condensation in the dryer 2 interior.

In normal operation the dryer 2 usually operates such that the recycle control 1 is in a partial recycle mode somewhere between the total recycle and non-recycle modes discussed hereinabove. This is accomplished by selectively positioning each of the adjustable louvers 100, 101 and 103 such that the proper ratio and degree of opening is provided to meter in recycle and fresh air and thereby control the humidity and temperature of the recycle air stream. In this manner excessive heat is not input into the drying operation, while still allowing dehydration of the grain to be dried in a reasonable amount of time. It is noted that in such a partial recycle mode one of the louvers 101 and 103 may be completely closed or both may be partially closed.

It is foreseen that the above discussed louvers could be varied substantially from the particular embodiment discussed while providing essentially the same control. It is also foreseen that automatic humidity and/or temperature sensing units could be provided for the dryer 2 which units could effectively control and positively regulate the humidity and temperature of the drying air by selectively adjusting the various louvers 100, 101 and 103 by conventional devices operating on and through the actuators 104, 105 and 106 respectively.

It is to be understood that while certain forms of the present invention have been illustrated and described, it is not to be limited to the specific forms or arrangement of parts herein described and shown.

Having thus described the invention, what is claimed and desired to secure by Letters Patent is:

1. A grain dryer comprising:

(a) an enclosure;

(b) at least one porous grain holding column located within said enclosure;

(c) said grain holding column having heating and cooling drying zones;

(d) a first blower communicating with the atmosphere outside said enclosure and forcing relatively cool atmospheric air through grain in said cooling zone;

(e) a second blower forcing relatively heated air through grain in said heating zone and dehydrating the grain;

(f) said second blower having an intake duct and a recycle control; said recycle control comprising:

(1) first adjustable closure means for selectively admitting a mixture of cool and heated air after passing through the grain into said second blower intake duct, whereby said mixture is recycled; and (2) second adjustable closure means communicating with the atmosphere and selectively admitting atmospheric air into said second blower intake duct;

(g) whereby said recycle control can be selectively adjusted to produce a non-recycle mode, a total recycle mode or a plurality of partial recycle modes within said dryer; and (h) venting means for releasing non-recirculated air from said enclosure.

2. In a grain dryer having heating and cooling grain drying zones wherein relatively cool air and heated air are flowed through grain in the cooling zone and heating zones respectively; said grain dryer including a recirculating blower, which during a recirculating mode, draws a mixture of said cool air and said heated air into an intake portion thereof and forces said mixture out after heating into the heating zone; and said dryer including exhaust mechanism to vent external of the dryer a portion of the heated mixture from the heating zone, the improvement comprising:

(a) a recycle control positioned near the intake portion of the recirculating blower including first control means for selectively allowing flow of ambient atmospheric air directly into said mixture of cool air and heated air entering the intake portion of the recirculating blower and second control means for selectively allowing flow of said mixture into the intake portion of the recirculating blower, thereby regulating the extent of dryer recirculation.

3. A grain dryer as set forth in claim 2 wherein:

(a) said cooling zone and said heating zone are contiguous and define a drying column area.

4. A grain dryer as set forth in claim 3 wherein said recycle control comprises:

(a) an inlet duct connected with said blower intake portion; and wherein:

(b) said first control means comprises a first aperture through said inlet duct for communication with the atmosphere; and includes (c) first adjustable closure means for said aperture for selectively metering the flow of ambient atmospheric air into the blower intake portion.

5. A grain dryer as set forth in claim 4 wherein:

(a) said second control means includes a second aperture disposed adjacent to and communicating with said drying column area; and wherein (b) during a full recirculating mode of said grain dryer, said first closure means is closed and air is drawn into said recirculating blower substantially wholly from said drying column area.

6. A grain dryer as set forth in claim 5 wherein:

(a) said inlet duct second aperture includes a second adjustable closure means therefor to selectively meter the flow of recirculated air into the blower intake portion, whereby during a full non-recirculating mode of said grain dryer, said second closure means is closed and said first closure means is open such that air is drawn into said recirculating blower substantially wholly from the atmosphere.

7. A grain dryer as set forth in claim 4, 5, or 6 wherein:

(a) said first closure means comprises an adjustable louver mounted in an outside side wall of the inlet duct.

8. A grain dryer as set forth in claim 4, 5, or 6 wherein:

(a) said first closure means comprises:

(1) an adjustable louver mounted in said inlet duct; and (2) a non-adjustable louver communicating with said adjustable louver and the atmosphere; said adjustable louver being mounted in an outer side wall of the inlet duct and positioned therein such that pivoting of said adjustable louver between closed and open positions respectively closes and opens communication between the atmosphere and the blower intake portion.

9. A grain dryer as set forth in claim 4, 5 or 6 wherein said first closure means comprises:

(a) a first adjustable louver mounted in an outside side wall of the inlet duct and communicating with the atmosphere for selectively admitting atmospheric air into the intake duct when said dryer is not in a total recycle mode;

(b) a second adjustable louver mounted in said inlet duct at a point near the intake portion thereof; and (c) a fixed louver mounted in an outer side wall of the inlet duct and positioned therein at a point between said second adjustable louver and the atmsphere, such that opening and closing of said second adjustable louver respectively closes and opens communication between the atmosphere and the blower intake portion through said fixed louver.

10. A grain dryer as set forth in claim 4, 5 or 6 wherein:

(a) said inlet duct has an aerodynamically streamlined interior shape with side walls which taper convergingly inwardly from an open end of the inlet duct to the intake portion of the recirculating blower for efficiently guiding the flow of air from the drying column area directly into the recirculating blower during the recirculating mode of the dryer.

11. A grain dryer as set forth in claim 10 including:

(a) arcuately shaped flashing connected with upper and lower edges of the inlet duct open end for streamline air flow into said inlet duct.

12. A grain dryer as set forth in claim 4 wherein:

(a) said recirculating blower is mounted in a room of the dryer with an open wall thereof communicating with the drying column area;

(b) said room includes a floor, a ceiling, opposed side walls and a rear wall; and (c) said open wall of the room is oriented toward said drying column area.

13. A grain dryer as set forth in claim 12 wherein:

(a) said duct open end extends vertically from said floor of the room to said ceiling of the room, and horizontally from an associated side wall of the room to said recirculatory blower, thereby forming a substantially closed area of the room disposed rearwardly of said recirculating blower;

(b) said recirculating blower includes a motor for driving the same; and (c) said motor is mounted in the closed area of the room to isolate said motor from exposure to debris in the recirculated air and thereby provide improved safety.

* * * * *